United States Patent [19]

McVeety

[11] 4,004,361

[45] Jan. 25, 1977

[54] VEHICLE OIL CHANGE, FILTER CHANGE AND TUNE UP REMINDER DEVICE

[75] Inventor: Harry H. McVeety, Brooklyn, N.Y.

[73] Assignee: The Raymond Lee Organization, Inc., New York, N.Y. ; a part interest

[22] Filed: Sept. 19, 1975

[21] Appl. No.: 614,896

[52] U.S. Cl. ..... 40/77.6

[51] Int. Cl.[2] ..... G09F 11/02

[58] Field of Search ..... 40/68, 129 C, 77.4, 40/77.6

[56] References Cited

UNITED STATES PATENTS

| | | | |
|---|---|---|---|
| 1,583,970 | 5/1926 | Haggerty | 40/68 |
| 1,778,593 | 10/1930 | Hain | 40/68 |
| 3,508,356 | 4/1970 | Ross | 40/129 C |
| 3,829,994 | 8/1974 | Dillon | 40/68 |

*Primary Examiner*—Louis G. Mancene
*Assistant Examiner*—Wenceslao J. Contreras
*Attorney, Agent, or Firm*—Daniel Jay Tick

[57] ABSTRACT

A pair of recesses are provided in the passenger compartment of a vehicle in clear view of an operator of the vehicle. Each of three groups of number wheels is rotatably mounted in a corresponding one of the recesses. Each group comprises a plurality of coaxially mounted number wheels in next-adjacent relation in units, tens, hundreds, thousands, 10 thousands and 100 thousands positions. The wheels of the first of the groups are manually rotatable to indicate a mileage at which the next oil change is due. The wheels of the second of the groups are manually rotatable to indicate a mileage at which the next change of oil filter is due. The wheels of the third of the groups are manually rotatable to indicate the mileage at which the next engine tune up is due.

1 Claim, 5 Drawing Figures

VEHICLE OIL CHANGE, FILTER CHANGE AND TUNE UP REMINDER DEVICE

DESCRIPTION OF THE INVENTION

The present invention relates to a vehicle oil change and tune up reminder device. More particularly, the invention relates to a vehicle oil change, oil filter change and tune up reminder device for a vehicle having a passenger compartment and an engine.

Objects of the invention are to provide a vehicle oil change, oil filter change and tune up reminder device of simple structure, which is inexpensive in manufacture, installed with facility and convenience in new and existing vehicles, and functions efficiently, effectively and reliably to indicate to the operator of a vehicle exactly when the next oil change is due, exactly when the next oil filter change is due and exactly when the next tune up is due, thereby avoiding the burning out of an engine, which commonly results from insufficient oil changes resulting in the circulation of grit and foreign material through the engine, to the extreme detriment of the engine and the great financial disadvantage of the operator.

In order that the invention may be readily carried into effect, it will now be described with reference to the accompanying drawing, wherein.

The vehicle oil change, oil filter change and tune up reminder device of the invention is for a vehicle 200 (FIG. 3) having a passenger compartment 201 (FIG. 3) and an engine (not shown in the FIGS.).

The vehicle oil change, oil filter change and tune up reminder device of the invention comprises first, second and third pairs of recesses 202, 203 and 204 provided in the passenger compartment 201 of the vehicle 200 in clear view of an operator of the vehicle.

Figure 2:
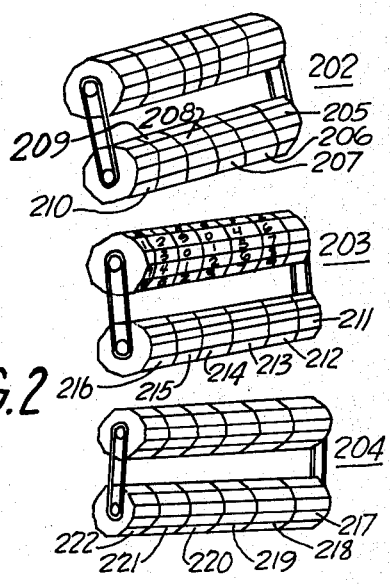
FIG. 2 is a perspective view of an embodiment of the number wheels of the reminder device of the invention.

Three groups of number wheels, as shown in FIG. 2, are provided. Each group of number wheels is rotatably mounted in a corresponding one of the recesses 202, 203 and 204. The first group of number wheels 202 comprises a plurality of coaxially mounted number wheels 205, 206, 207, 208, 209 and 210, the second group of number wheels 203 comprises a plurality of coaxially mounted number wheels 211, 212, 213, 214, 215 and 216, and the third group of number wheels 204 comprises a plurality of coaxially mounted number wheels 217, 218, 219, 220, 221 and 222, respectively. The number wheels 205 to 210, 211 to 216, and 217 to 222 are positioned in next-adjacent relation in units, tens, hundreds, thousands, ten thousands and hundred thousands positions.

The wheels of the first group of number wheels 205 to 210 are manually rotatable to indicate a mileage at which the next engine oil change is due. The wheels of the second group of number wheels 211 to 216 are manually rotatable to indicate a mileage at which the next oil filter change is due. The wheels of the third group of number wheels 217 to 222 are manually rotatable to indicate a mileage at which the next engine tune up is due.

In another embodiment of the invention, also shown in FIG. 2, the number wheels are duplicated, so that there are six groups of identical number wheels. Each pair of groups of number wheels are coupled to each other in a manner whereby the rotation of a number wheel of one group of the pair rotates the corresponding number wheel of the other group of the pair to the same number. This enables one group of number wheels to be positioned at an inaccessible glass window illuminated by a dashboard light and the other group of each pair of number wheels to be positioned at an accessible location where the wheels may be readily manually positioned. Although only two coupling bands are shown for each set of groups of number wheels in FIG. 2, in order to maintain the clarity of illustration, each number wheel of one group is directly coupled to the corresponding number wheel of the other group of each set.

Figure 1:
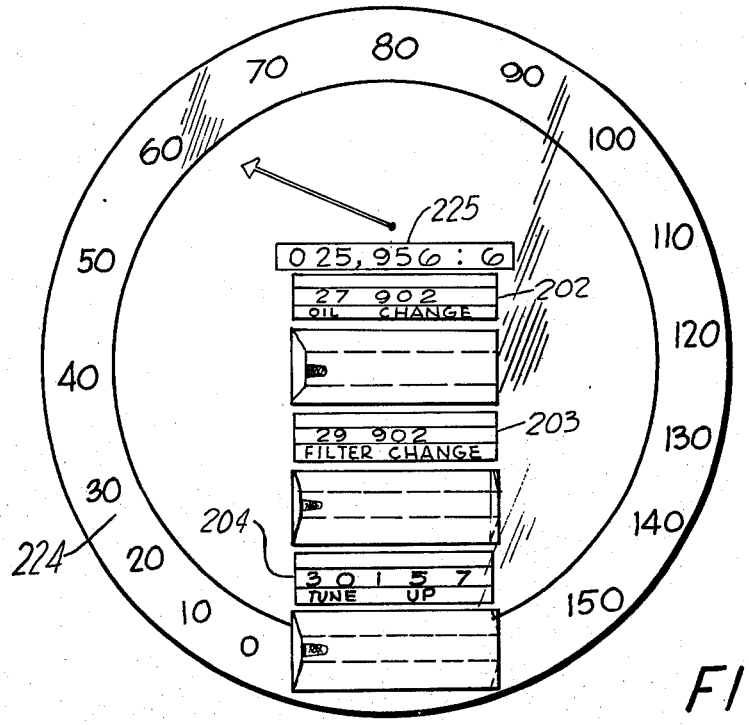
FIG. 1 is a view of an embodiment of the vehicle oil change, oil filter change and tune up device of the invention.
Figure 3:
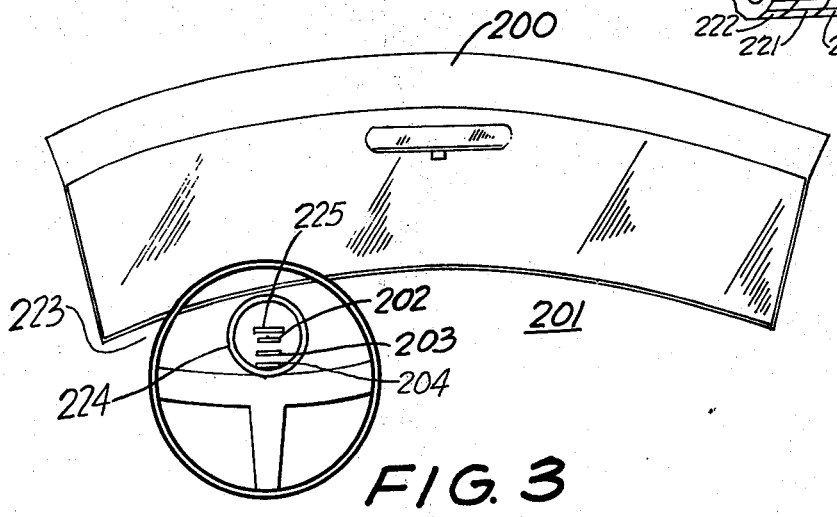
FIG. 3 is a view of the embodiment of FIG. 1, on a reduced scale in the interior of a vehicle.

As shown in FIGS. 1 and 3, the vehicle 200 has a dashboard 223, and a speedometer 224 and odometer 225 on the dashboard. The recesses 202, 203 and 204 are formed in the dashboard in close proximity with the speedometer 224, in the embodiment of FIGS. 1 and 3 and are covered with glass and illuminated by the dashboard light.

Figure 4:
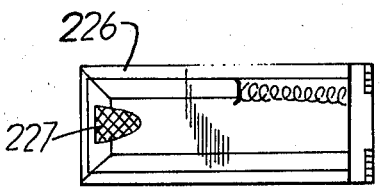
FIG. 4 is a view of an embodiment of a door of the reminder device of the invention in closed position.
Figure 5:
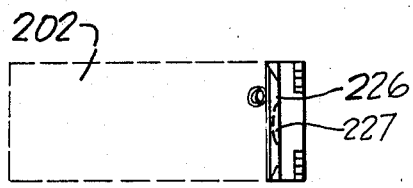
FIG. 5 is a view of the door of FIG. 4 in open position.

A spring-biased transparent door 226 is hingedly affixed adjacent the recess 202 for selectively closing and opening such recess to provide access to the group of number wheels therein. Other opaque doors, shown in FIG. 1, are hingedly affixed adjacent the recesses 203 and 204 for selectively closing and opening such recesses to provide access to the group of number wheels therein. A finger grip recess 227 is provided in each door (FIGS. 4 and 5).

While the invention has been described by means of specific examples and in specific embodiments, I do not wish to be limited thereto, for obvious modifications will occur to those skilled in the art without departing from the spirit and scope of the invention.

I claim:

1. A vehicle oil change, oil filter change and tune up reminder device for a vehicle having a passenger compartment a dashboard with a speedometer and odometer thereon, and an engine, said reminder device comprising a plurality of recesses formed in the dashboard in close proximity with the speedometer in the passenger compartment of a vehicle in clear view of an operator of the vehicle;

three groups of number wheels each rotatably mounted in a corresponding one of the recesses and each comprising a plurality of coaxially mounted number wheels in next-adjacent relation in units, tens, hundreds, thousands, ten thousands and hundred thousands positions, the wheels of a first of said groups being manually rotatable to indicate a mileage at which the next engine oil change is due, the wheels of the second of said groups being manually rotatable to indicate a mileage at which the next oil filter change is due, and the wheels of the third of said groups being manually rotatable to indicate a mileage at which the next engine tune up is due; and a pair of spring-biased doors each hingedly affixed adjacent a corresponding one of the recesses for selectively closing and opening the recesses.

* * * * *